US009609422B2

(12) United States Patent
Honda et al.

(10) Patent No.: US 9,609,422 B2
(45) Date of Patent: Mar. 28, 2017

(54) HEADPHONE UNIT AND EAR MUFF UNIT

(71) Applicants: Yoji Honda, Tokyo (JP); Kenzo Tsuihiji, Tokyo (JP); Koichiro Tanoue, Tokyo (JP); Kenji Arai, Tokyo (JP)

(72) Inventors: Yoji Honda, Tokyo (JP); Kenzo Tsuihiji, Tokyo (JP); Koichiro Tanoue, Tokyo (JP); Kenji Arai, Tokyo (JP)

(73) Assignee: Kabushiki Kaisha Audio-Technica, Tokyo (JP)

( * ) Notice: Subject to any disclaimer, the term of this patent is extended or adjusted under 35 U.S.C. 154(b) by 0 days.

(21) Appl. No.: 14/936,747

(22) Filed: Nov. 10, 2015

(65) Prior Publication Data

US 2016/0142811 A1 May 19, 2016

(30) Foreign Application Priority Data

Nov. 18, 2014 (JP) ..... 2014-233914

(51) Int. Cl.
*H04R 25/00* (2006.01)
*H04R 1/10* (2006.01)
*H04R 5/033* (2006.01)

(52) U.S. Cl.
CPC ..... *H04R 1/1066* (2013.01); *H04R 1/1058* (2013.01); *H04R 5/0335* (2013.01); *H04R 1/1008* (2013.01); *H04R 2201/107* (2013.01); *H04R 2420/07* (2013.01)

(58) Field of Classification Search
CPC .... H04R 1/1008; H04R 1/105; H04R 1/1058; H04R 1/1066; H04R 5/0335; H04R 2201/107; H04R 2201/109; H04R 2420/07; H04M 1/05
USPC ..... 381/309, 370, 371, 374, 375, 376, 379, 381/380, 381; 181/128, 129, 130, 135; 379/430
See application file for complete search history.

(56) References Cited

U.S. PATENT DOCUMENTS 4,875,233 A * 10/1989 Derhaag ..... H04M 1/05 379/430
5,655,026 A * 8/1997 Peters ..... H04R 1/1066 381/370
2007/0036386 A1* 2/2007 Amae ..... H04M 1/05 381/388
2012/0087534 A1* 4/2012 Pelland ..... H04R 1/1041 381/380

FOREIGN PATENT DOCUMENTS

JP U-6-44232 11/1994
JP U-7-18228 4/1995
JP P-8-32099 3/1996

* cited by examiner

*Primary Examiner* — Huyen D Le
(74) *Attorney, Agent, or Firm* — Whitham, Curtis & Cook, P.C.

(57) ABSTRACT

Provided is a headphone unit including a housing having a convex portion and accommodating a driver unit, a support in contact with part of the outer surface of the convex portion, and a frictional member in contact with the support and the outer surface of the convex portion. The frictional member generates greater friction against the convex portion than the friction between the support and the convex portion. The housing is swingably joined to the support.

8 Claims, 4 Drawing Sheets

HEADPHONE UNIT AND EAR MUFF UNIT

BACKGROUND OF THE INVENTION

Technical Field

The present invention relates to a headphone unit and an ear muff unit.

Background Art

A typical headphone set includes a pair of housings each accommodating a driver unit. The housings are joined to each other with a head band. These housings are each provided with an ear pad attached thereto. The housings are joined to respective supports which are joined to the two respective ends of the head band.

The positions of the housings relative to the head band and the relative posture between the housings should be adjustable depending on the physical size or preference of the user. To satisfy the requirements, the housings may be fixed to the respective supports of the head band with screws in a possible fixing structure. Unfortunately, the movable ranges of the housings relative to the supports depend on the tightening torque of the screws or dimensions of the housings and supports. Such tightening torque of the screws and dimensions of the components are difficult to control in mass production. In addition, the housings cannot move smoothly relative to the supports, because the housings and supports are composed of hard materials such as plastics.

In such circumstances, a requirement for a headphone set including housings with ear pads is smooth movement of the housings relative to the supports.

A conventional headphone set with a microphone is disclosed in Japanese examined utility model application publication No. H06-44232, for example. The headphone set includes, for example, an annular wave spring and two annular resin plates holding the spring therebetween on the mounting surfaces of a microphone holder and a headphone hanger.

Another headphone set is disclosed in Japanese examined utility model application publication No. H07-18228, for example. The headphone set includes a holder having a groove along its axis. After insertion of a microphone boom through the groove, the holder is inserted into the body of the headphone set. The microphone boom is held by spring force of the holder.

A device for mounting driver units is disclosed in Japanese examined patent application publication No. H08-32099, for example. The device includes a cabinet and a substantially spherical rotation shaft integrated with the cabinet and held between receiving portions on the inner surfaces of a pair of holders. The holders are rotatably mounted to the cabinet.

SUMMARY OF INVENTION

An object of the present invention is to provide a headphone unit and an ear muff unit including a housing and a support in which the housing can smoothly move relative to the support.

A headphone unit according to an embodiment of the present invention includes a housing having a convex or spherically protruding portion and accommodating a driver unit, a support in contact with part of an outer surface of the convex portion, and a frictional member in contact with the support and the outer surface of the convex portion. The frictional member generates greater friction against the convex portion than the friction generated between the support and the convex portion. The housing is swingably joined to the support.

An ear muff unit according to an embodiment of the present invention includes a housing having a convex portion, a support in contact with part of an outer surface of the convex portion, and a frictional member in contact with the support and the outer surface of the convex portion. The frictional member generates greater friction against the convex portion than the friction generated between the support and the convex portion. The housing is swingably joined to the support.

DESCRIPTION OF PREFERRED EMBODIMENTS

Embodiments of the headphone unit according to the present invention will now be described with reference to the attached drawings.

Headphone Set (1)

Figure 1:
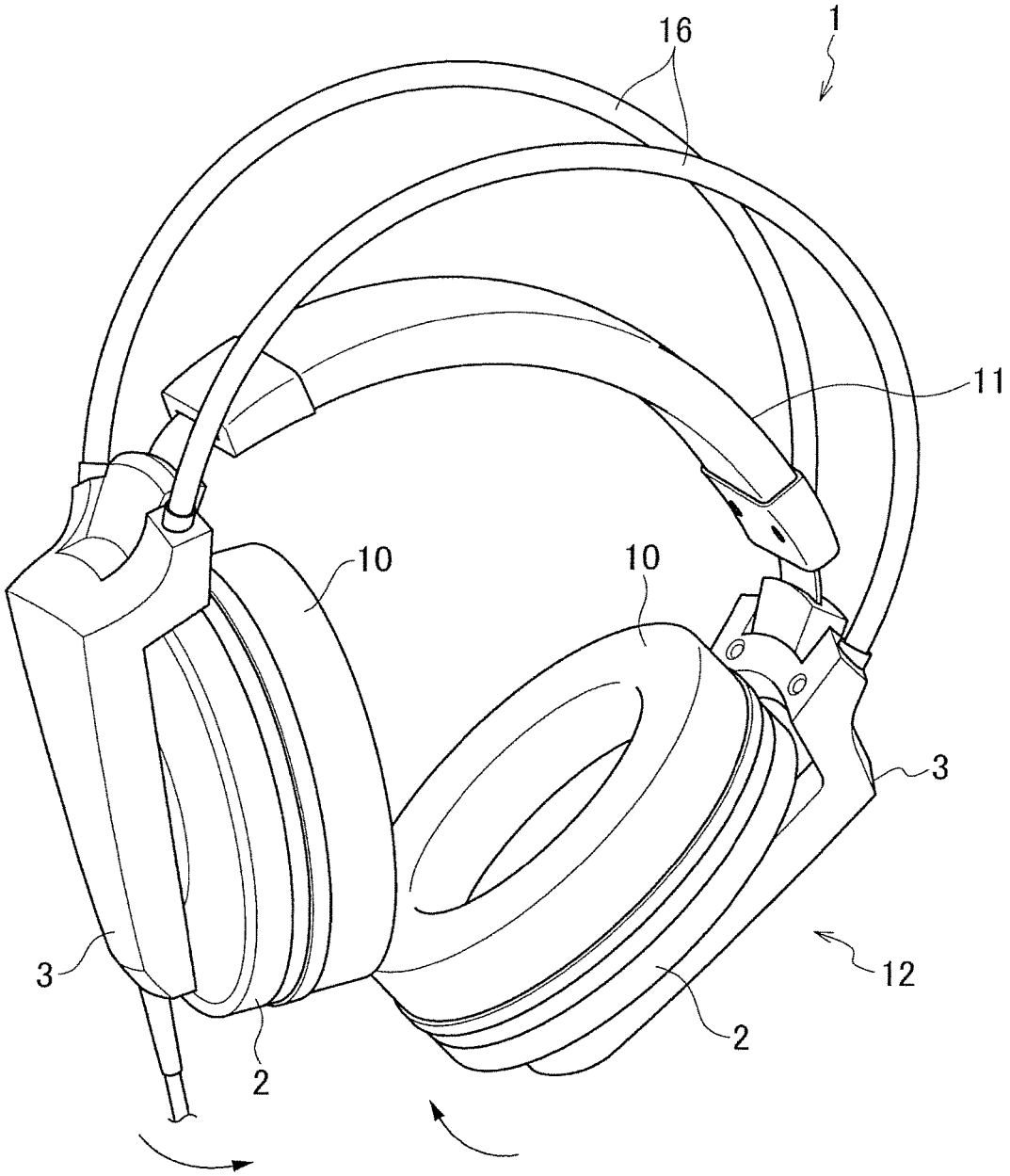
FIG. 1 is a perspective view of a headphone set according to an embodiment of the present invention.
Figure 2:
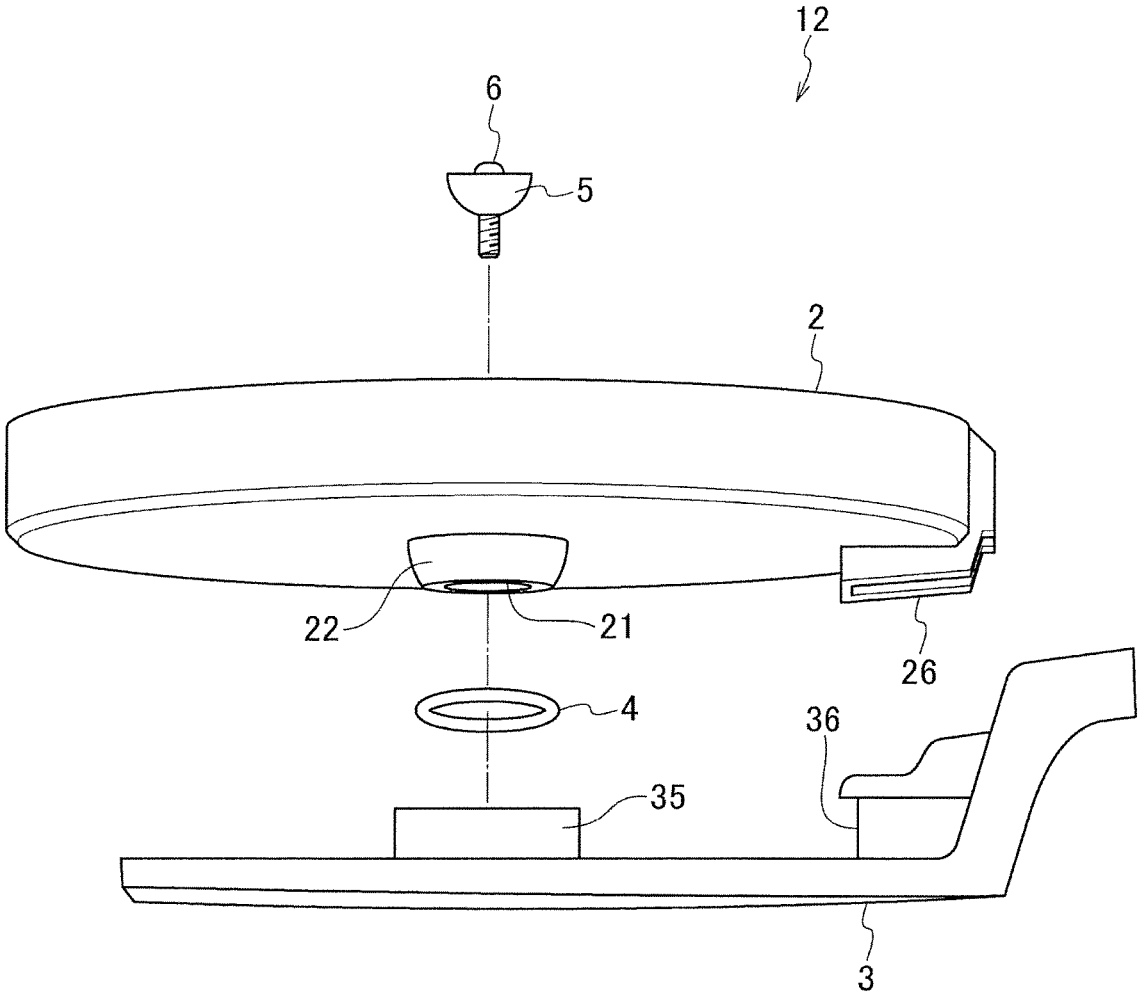
FIG. 2 is an exploded perspective view of a right headphone unit of the headphone set illustrated in FIG. 1.

With reference to FIGS. 1 and 2, a headphone set 1 according to an embodiment of the present invention includes housings 2, supports 3, O-rings 4, stops 5, screws 6, ear pads 10, and a head band 11. FIG. 2 is an exploded perspective view of a right headphone unit 12, without illustration of the ear pad 10.

The housing 2 is a flat member which is a substantially elliptical column. The housing 2 supports the ear pad 10, which is a substantially elliptic cylinder, and accommodates a driver unit. The ear pad 10 is fixed to a first surface of the housing 2. The driver unit transmits sound waves through the first surface of the housing 2. The support 3 is fixed to a second or bottom surface of the housing 2. The second surface is outer surface and is opposed to the first surface.

The support 3 joins the housing 2 to the head band 11. The support 3 according to the embodiment is a substantially rectangular parallelepiped. The support 3 is disposed along the diameter of the second surface of the housing 2. The housing 2 is substantially concentrically fixed to the support 3 with the screw 6. The housing 2 and the support 3 are composed of plastics, for example.

First ends of the right and left supports 3 are respectively joined to two ends of the head band 11. During the use, the head band 11 is disposed on the head of the user so as to extend from the right side to the left side of the user's head. The head band 11 includes a length-adjusting mechanism that can adjust the relative distance between the right and left housings. The supports 3 are also joined to two resilient members 16 for urging the housings 2 to the sides of the user's head.

The relative angle is adjustable between the second surface of the housing 2 and a first surface of the support 3 facing the second surface of the housing 2. In specific, the relative angle between the housing 2 and the support 3 can be adjusted by moving the housing 2 around the rotational axis which is perpendicular to the longitudinal direction of the screw 6 and extends through the middle of the screw 6. Exemplary rotational directions of the housings 2 are indicated by the arrows in FIGS. 1 and 4.

Joining Structure Between Housing 2 and Support 3

Figure 3:
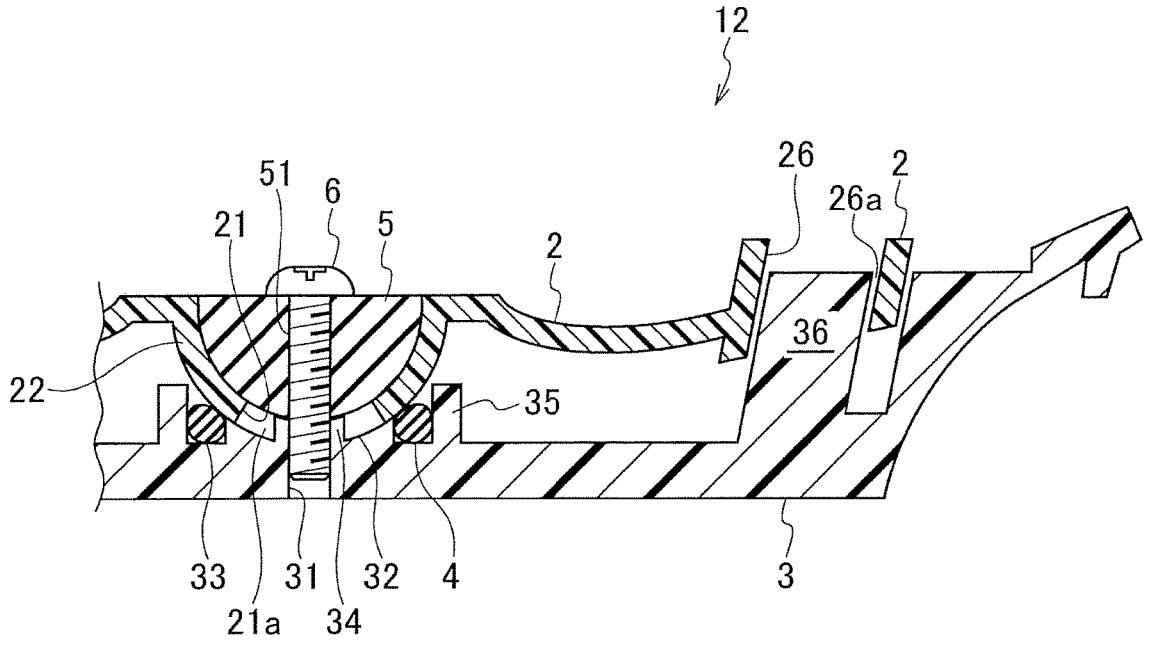
FIG. 3 is a longitudinal sectional view of the right headphone unit illustrated in FIG. 2.

As illustrated in FIG. 3, the housing 2 includes a relief hole 21 and a bowl portion 22. The support 3 includes a hole 31 for receiving a fixing member, a first receiving portion 32 for receiving a bowl portion 22, a groove 33, a second receiving portion 34 for receiving a stop 5, and a cylindrical rib 35.

The relief hole 21 is positioned substantially at the center of the second or bottom surface of the housing 2. When viewed from the second surface of the housing 2, the bowl portion 22 has an outer surface convex toward the support 3. When viewed from the first surface of the housing 2, the bowl portion 22 has a concave or spherically recessed inner surface. The outer surface of the bowl portion 22 is in contact with the first receiving portion 32 of the support 3, while the inner surface of the bowl portion 22 is in contact with a stop 5, which is described below. The bowl portion 22 has a hemisphere shape. The outer surface and inner surface of the bowl portion 22, the outer surface of the stop 5 in contact with the inner surface of the bowl portion 22, and the first receiving portion 32 of the support 3 in contact with the outer surface of the bowl portion 22 are spherical surfaces concentrically aligned. In other words, the support 3 has a contact surface in contact with part of the bowl portion 22.

The hole 31 is disposed substantially at the center of the first surface of the support 3 facing the housing 2. The first receiving portion 32 surrounds the hole 31 and has a top surface slightly concave so as to conform to the outer surface of the bowl portion 22. In specific, the first receiving portion 32 protrudes from the first surface of the support 3 facing the housing 2 and has a concave or spherically recessed top surface conforming to the outer surface of the bowl portion 22.

The O-ring 4 is an elastic ring having a substantially circular cross-section. The O-ring 4 is held in a groove 33 defined between the outer periphery of the first receiving portion 32 and the inner periphery of a rib 35. The O-ring 4 is in contact with the outer surface of the bowl portion 22, generating an appropriate friction between the housing 2 and the support 3. In place of an elastic material, the O-ring 4 may be composed of any other material that generates greater friction against the bowl portion 22 and the first receiving portion 32 than the friction between the bowl portion 22 and the first receiving portion 32. The O-ring 4 surrounds the entire outer periphery of the first receiving portion 32. In other words, the O-ring 4 surrounds the entire periphery of a contact portion between the housing 2 and the support 3. This structure would keep the housing 2 in contact with the O-ring 4 if the housing 2 inclines to any direction relative to the support 3.

The O-ring 4 in the headphone unit 12 may be replaced with a sheet or ring composed of any frictional materials. For the headphone unit 12 including a frictional sheet, the support 3 includes an appropriate holding means instead of the groove 33 for holding the frictional sheet. The O-ring 4 may be replaced with a substantially truncated cone cylinder conforming to the outer surface of the bowl portion 22.

The stop 5 has a substantially hemisphere shape. The stop 5 and the support 3 hold the bowl portion 22 therebetween. The stop 5 has a through hole 51 through which the screw 6 penetrates. The through hole 51 extends substantially along the central axis of the stop 5. The stop 5 has a hemispherical outer surface convex toward and conforming to the inner surface of the bowl portion 22. In addition, the top edge (facing downward in FIG. 3) of stop 5 is in contact with the second receiving portion 34. The second receiving portion 34 is a cylindrical protrusion disposed between the hole 31 and the first receiving portion 32. The second receiving portion 34 penetrates through the relief hole 21 of the housing 2.

The screw 6 penetrates through the through hole 51 and is threaded into an internal thread in the hole 31 such that the housing 2 is joined to the support 3. A washer may be disposed between the head of the screw 6 and the stop 5.

The stop 5 and the second receiving portion 34 are fixed each other by the pressure of the screw 6. The dimensions of each component are designed such that the tightening force of the screw 6 applied to the stop 5 and the second receiving portion 34 is not transmitted to the bowl portion 22. Such a design enables the bowl portion 22 to swing between the first receiving portion 32 and the stop 5. The swinging movement of the bowl portion 22 is guided by the first receiving portion 32. The outer surface of the bowl portion 22 and the top surface of the first receiving portion 32 guiding the swinging movement of the bowl portion 22 are spherical surfaces concentrically aligned. The housing 2 thereby swings along a spherical trail relative to the support 3.

In the embodiment, the stop 5 is fixed to the second receiving portion 34 with the screw 6, although any other fixing means may be used. For example, the stop 5 may be fixed to the second receiving portion 34 with adhesive. Alternatively, the stop 5 may be integrated with the second receiving portion 34.

As illustrated in FIG. 3, a truncated cone gap 21*a* is defined between the periphery of the relief hole 21 and the second receiving portion 34. The gap 21*a* surrounds the entire periphery of the second receiving portion 34. The gap 21*a* enables the bowl portion 22 to swing between the first receiving portion 32 and the second receiving portion 34. The swinging movement of the bowl portion 22 can change the angle of the housing 2 relative to the support 3.

In the embodiment, the second receiving portion 34 protrudes from the first surface of the support 3 and is in contact with the stop 5. The gap 21*a* is thereby defined between the relief hole 21 and the second receiving portion 34. Alternatively, the stop 5 may have a cylindrical protrusion extending toward the first surface of the support 3. In this case, the gap 21*a* is defined between the relief hole 21 and the stop 5.

The groove 33 has a ring cross-section and is defined between the first receiving portion 32 and the rib 35. The groove 33 holds the O-ring 4 therein. The wall defining the inner periphery of the groove 33 has a smaller height than the diameter of the cross-section of the O-ring 4. Part of the O-ring 4 therefore protrudes from the groove 33. The protruding portion of the O-ring 4 is in contact with the outer surface of the bowl portion 22.

The relative distance between the bowl portion 22 and the first receiving portion 32 is maintained by stiction generated between the O-ring 4 and the bowl portion 22. In addition, the bowl portion 22 scrapes against the O-ring 4, when sliding on the first receiving portion 32. Kinetic frictional force of the O-ring 4 is thereby generated and enables the bowl portion 22 to smoothly slide on the first receiving portion 32. In addition, since the O-ring 4 keeps in contact with the bowl portion 22 while the bowl portion 22 is sliding on the first receiving portion 32, the stiction generated between the O-ring 4 and the bowl portion 22 maintains the angle of the bowl portion 22 relative to the first receiving portion 32.

The elastic O-ring 4 in contact with the bowl portion 22 absorbs a variation in torque of the screw 6, which eliminates the need for controlling the torque of the screw 6. This leads to ready control of an assembly process in the production of the headphone set 1.

Figure 4:
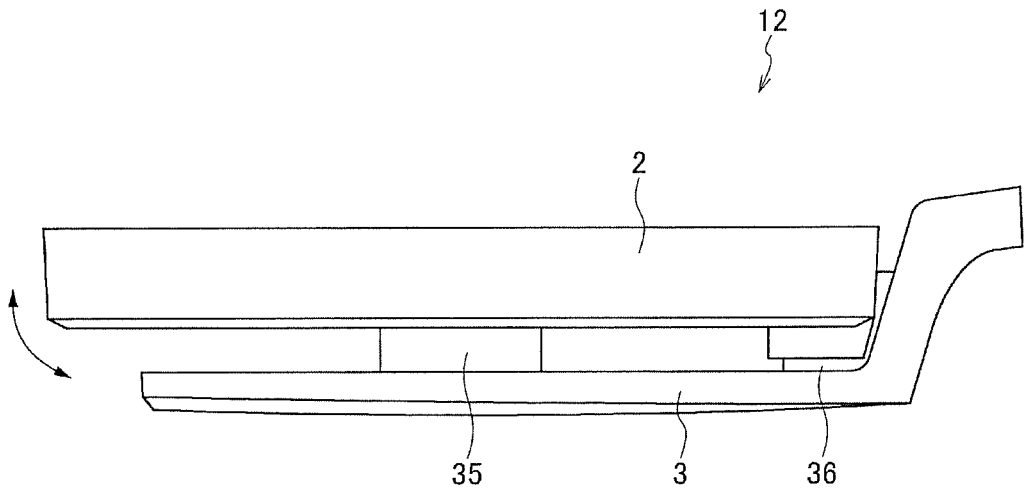
FIG. 4 is a side view of the right headphone unit illustrated in FIG. 2.

As illustrated in FIG. 4, the rib 35 is a cylindrical wall surrounding the outer periphery of the O-ring 4. The rib 35 blocks the O-ring 4 from exposing out of the headphone unit 12. The housing 2 can incline to an angle at which the bottom edge of the bowl portion 22 reaches the top end of the rib 35.

Structures of Receiving Hole 26 and Protrusion 36

With reference to FIG. 2, the housing 2 further includes a receiving hole 26 radially disposed on the housing 2. The support 3 further includes a protrusion 36 radially disposed on the support 3. The receiving hole 26 is a substantially square hole disposed in the second surface of the housing 2 facing the support 3 and disposed adjacent to the outer periphery of the housing 2. The protrusion 36 is disposed on the first surface of the support 3 facing the housing 2, and is positioned so as to fit into the receiving hole 26 at the integration of the housing 2 and the support 3. The receiving hole 26 has a larger outer perimeter than that of the protrusion 36 so as to receive the protrusion 36 therein. The receiving hole 26 may have any shape other than a substantial square, and may have a substantially circular shape. The protrusion 36 may be hollow or solid.

A gap 26*a* is defined between the receiving hole 26 and the protrusion 36. The gap 26*a* facilitates the sliding movement of the housing 2 relative to the support 3. At the same time, the protrusion 36 fit in the receiving hole 26 inhibits the housing 2 from rotating around the rotational axis along the longitudinal direction of the screw 6.

The protrusion 36 has such a height as to remain in the receiving hole 26 even when the housing 2 defines a maximum angle relative to the support 3. Such a structure inhibits the housing 2 from rotating around the rotational axis along the longitudinal direction of the screw 6 upon the sliding of the housing 2.

Alternatively, the support 3 may include the receiving hole 26 and the housing 2 may include a protrusion 36.

The headphone unit according to the above-described embodiments but having no driver unit in the housing 2 may be used as an ear muff unit.

According to the embodiment described above, the O-ring 4 surrounding the outer periphery of the first receiving portion 32 and in contact with the bowl portion 22 can achieve smooth movement of the housing 2 relative to the support 3. In specific, an appropriate friction between the O-ring 4 and the bowl portion 22 allows for the positional adjustment of the ear pads relative to the head band depending on the physical size or preference of the user.

What is claimed is:

1. A headphone unit comprising:

a housing having a convex portion and accommodating a driver unit;

a support having a contact surface in contact with part of an outer surface of the convex portion;

a frictional member in contact with the support and the outer surface of the convex portion, the frictional member generating greater friction against the convex portion than the friction generated between the support and the convex portion; and a stop in contact with an inner surface of the convex portion, wherein the housing is swingably joined to the support, the housing comprises a hole extending through the convex portion, the support comprises a first protrusion extending through the hole of the housing, and wherein the first protrusion of the support is in contact with the stop.

2. The headphone unit according to claim 1, wherein the outer surface of the convex portion, the contact surface of the support in contact with the outer surface of the convex portion, and an outer surface of the stop in contact with the inner surface of the convex portion are spherical surfaces concentrically aligned.

3. The headphone unit according to claim 1, wherein a gap is defined between the periphery of the hole and the first protrusion of the support.

4. The headphone unit according to claim 1, wherein the angle between the housing and the support is adjustable.

5. The headphone unit according to claim 1, wherein kinetic friction is generated between the frictional member and the housing when the housing swings relative to the support.

6. The headphone unit according to claim 1, wherein the frictional member is an elastic ring surrounding a contact portion between the housing and the support.

7. The headphone unit according to claim 1, wherein the support comprises a second protrusion on a surface facing the housing, and the housing comprises a receiving hole larger in outer perimeter than the second protrusion so as to receive the second protrusion in the receiving hole.

8. An ear muff unit comprising:

a housing having a convex portion;

a support in contact with part of an outer surface of the convex portion;

a frictional member in contact with the support and the outer surface of the convex portion, the frictional member generating greater friction against the convex portion than the friction generated between the support and the convex portion; and a stop in contact with an inner surface of the convex portion, wherein the housing is swingably joined to the support, the housing comprises a hole extending through the convex portion, the support comprises a first protrusion extending through the hole of the housing, and wherein the first protrusion of the support is in contact with the stop.

* * * * *